United States Patent [19]

White

[11] Patent Number: 4,976,653

[45] Date of Patent: Dec. 11, 1990

[54] MATERNITY GARMENT WITH TWO-POSITION SUPPORT BAND

[76] Inventor: Barbara E. White, 208 States St., Apt. #2, San Francisco, Calif. 94114

[21] Appl. No.: 318,900

[22] Filed: Mar. 3, 1989

[51] Int. Cl.[5] ..... A41B 9/00; A41D 1/00

[52] U.S. Cl. ..... 450/155; 2/78 R; 2/109; 2/221; 2/237; 2/236

[58] Field of Search ..... 2/73, 76, 78 D, 78 R, 2/104, 109, 115, 217, 220, 221, 236, 237, 243 B, 402, 403, 406; 450/155

[56] References Cited

U.S. PATENT DOCUMENTS

| | | | |
|---|---|---|---|
| 1,329,329 | 1/1920 | Straub, Jr. | 2/78 R |
| 1,372,977 | 3/1921 | Prokesch | 2/76 |
| 1,867,630 | 7/1932 | Rambo | 2/78 R |
| 1,876,311 | 9/1932 | McDonald | 2/78 R |
| 1,948,444 | 2/1934 | Krein | 2/237 |
| 2,130,552 | 9/1938 | Kühn | 2/237 |
| 2,659,367 | 11/1953 | Blatt | 2/407 X |
| 2,863,152 | 12/1958 | Blatt | 2/407 |
| 3,101,718 | 8/1963 | Rocker | 2/305 |
| 3,174,482 | 3/1965 | Parrott | 450/155 X |
| 3,843,973 | 10/1974 | Dillenburger | 2/236 |
| 4,506,390 | 3/1985 | Stern | 2/221 |
| 4,523,337 | 6/1985 | Leibowitz | 2/237 |
| 4,557,268 | 12/1985 | Maddux et al. | 450/155 |
| 4,669,130 | 6/1987 | Brown | 2/403 |
| 4,675,918 | 6/1987 | O'Brien | 2/402 |
| 4,697,592 | 10/1987 | Maddux et al. | 450/155 |

FOREIGN PATENT DOCUMENTS

| | | | |
|---|---|---|---|
| 2583622 | 12/1986 | France | 2/109 |

*Primary Examiner*—Werner H. Schroeder
*Assistant Examiner*—Jeanette E. Chapman
*Attorney, Agent, or Firm*—Owen, Wickersham & Erickson

[57] ABSTRACT

A maternity garment which provides extra support during bodily activity, comprises an upper body section connected to a lower body section and a continuous elastomeric band extending around the lower body section. The band is connected to the garment by a hinge member attached along one edge of the band and to the garment. Thus, the band can be moved from a relatively low position on the garment and the wearer to a relatively high position in order to provide a range of support to accommodate different wearer sizes and wearer activities.

3 Claims, 1 Drawing Sheet

MATERNITY GARMENT WITH TWO-POSITION SUPPORT BAND

This invention relates to clothing apparel and more particularly to a garment for pregnant women having a surrounding two-position band for supporting a wearer's critical body regions during bodily activity.

BACKGROUND OF THE INVENTION

During the normal term of pregnancy, most women desire to remain as active as possible, despite the fact that their increasing size tends to reduce mobility. As a woman's pregnancy progresses, certain of her muscles and other body components become subject to increased stress and fatigue and thus need additional support, especially during exercise activity. For example, the abductor muscles in the abdominal area and the thoraxes and lumbar spine in the back area are particularly vulnerable to fatigue. However, it has been found that if proper and adequate bodily support can be provided a larger degree of comfortable mobility can be maintained making it possible for a pregnant woman to exercise and move about or even dance in a substantially improved manner.

A general object of the present invention is to provide a wearing apparel for pregnant women that provides such a degree of support for a wearer which lessens the stress on her muscles and thereby allows her greater comfort and mobility.

Another object of the invention is to provide an article of clothing for pregnant women which has a multi-muscle group supporting band that can quickly be moved from one relatively low position around the abductor muscles and lumbar spine area to another higher position around the abdominal and thoraxes areas to thereby afford two different degrees or types of support for different bodily movements.

SUMMARY OF THE INVENTION

In accordance with the principles of the invention a one-piece garment for pregnant women is provided having a lower pants section with leg holes and an upper body section with shoulder straps attached to a back portion that forms the garment arm holes. Between these two sections is a continuous elastomeric band that is located to fit generally around the wearer's waist, but more specifically at an angle downwardly from the back of the wearer towards her frontal abdominal area. The elastomeric band is attached along one of its edges to the garment so that it can be moved back and forth as on a hinge to be in either of two different positions on the wearer's body. In a lower position with the band turned downwardly, the band passes across the wearer's lumbar back region and then forwardly and downwardly so that it fits well below the wearer's abdomen. When desired, the wearer can turn or flip the band to its upward position so that it supports the wearer's thoraxes and frontal regions at a somewhat higher level. Thus, the movable waist band allows the wearer a range of positions which enable her to maintain maximum comfort and support for different physical activities and conditions.

Other objects advantages and features of the invention will become apparent from the following detailed description of one embodiment thereof, presented in conjunction with the accompanying drawing.

Detailed Description of Embodiment

The present invention is particularly adaptable to a garment that may be worn by pregnant women that naturally have an enlarged abdomen and to a garment that provides a range of support as the wearer is exercising. For example, during aerobic exercising or dancing where bodily activity is at a relatively high level, support for the wearer's enlarged abdomen is highly desirable, if not necessary. Also, the most effective support may be required at somewhat different locations for different conditions of the wearer and for various forms of exercising activity.

Figure 1:
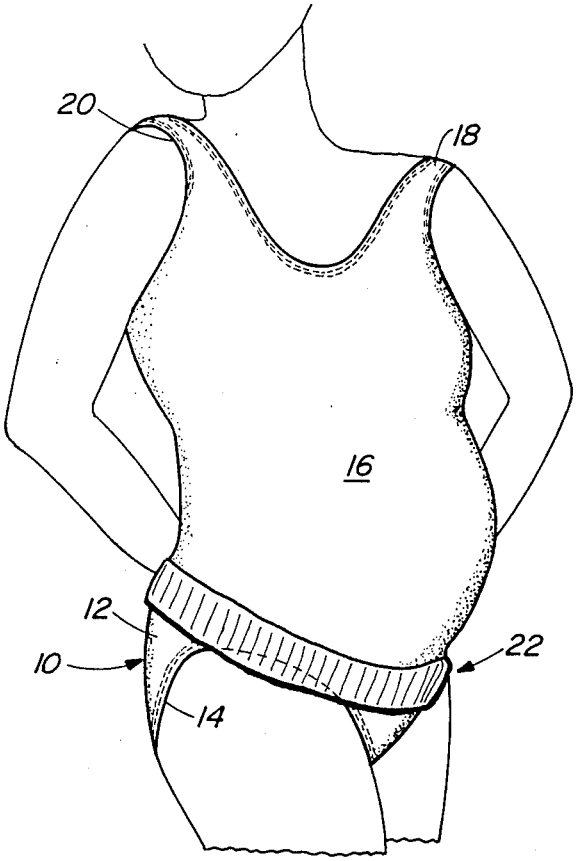
FIG. 1 is a view in perspective of a garment according to the present invention as it appears with its movable waist band in the down or lower position on a typical wearer.

With reference to the drawing, FIG. 1 shows a garment 10 embodying principles of the present invention as it appears when worn by a pregnant woman as represented typically. The garment has a lower pants-like section 12 with leg holes 14 and a connected upper section 16 with shoulder straps 18 that form arm holes 20. A relatively broad waist band 22 is attached to the garment at a location between the upper and lower sections.

Figure 1A:
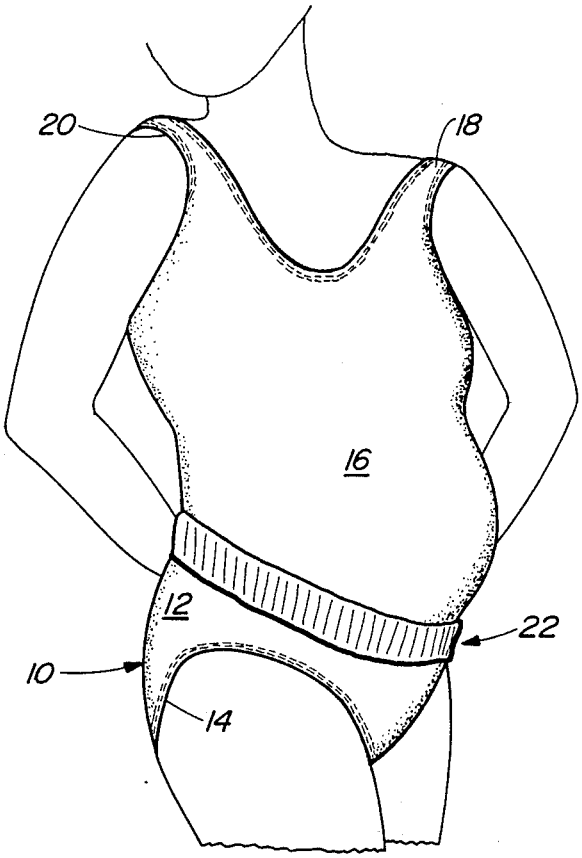
FIG. 1A is a view in perspective similar to FIG. 1 showing the garment according to the invention with its movable waist band in the up or higher position.

In accordance with the invention, the band 22 is attached to the garment so that it can assume a relatively low position, as shown in FIG. 1 or a relatively high position, as shown in FIG. 1A. In both positions the elastic band is stretched to fit under tension around the wearer's trunk to provide support for different frontal and back muscle groups. The capability of moving the band from its lower to its upper positions enables the wearer to accommodate different conditions due to the type of activity, the wearer's particular figure, etc.

Figure 2:
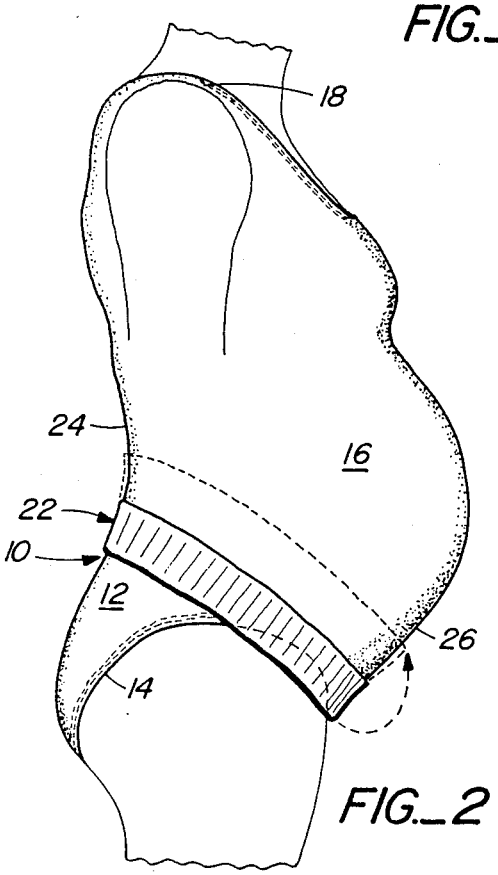
FIG. 2 is a view in side elevation of the garment of FIGS. 1 and 1A showing the waist band in its down position with the up position shown by a dotted line.

As shown best in FIG. 2, the band 22 in its lower position extends across the wearer's back or lumbar spine region 24 and then downwardly toward her lower frontal and abductor muscle region 26. In its upper position, shown by the dotted line in FIG. 2 and in FIG. 1A, the band 22 extends higher across the thoraxes region in the wearer's back and also higher across the abdominal region to support the abdominal muscles. This upper position may be more comfortable and also more supportive for certain wearers during their various bodily activities.

In general, the band 22 is attached to the garment 10 so that it is relatively high across the back portion of the lower pants-like section 12 and relatively low across the frontal portion of the lower section. Thus, as shown in FIG. 2, the band 22 on the garment extends forwardly and downwardly from the back region to the frontal crotch area of the wearer, thereby enabling it to provide support near the lower region of the wearer's abdomen.

Figure 3:
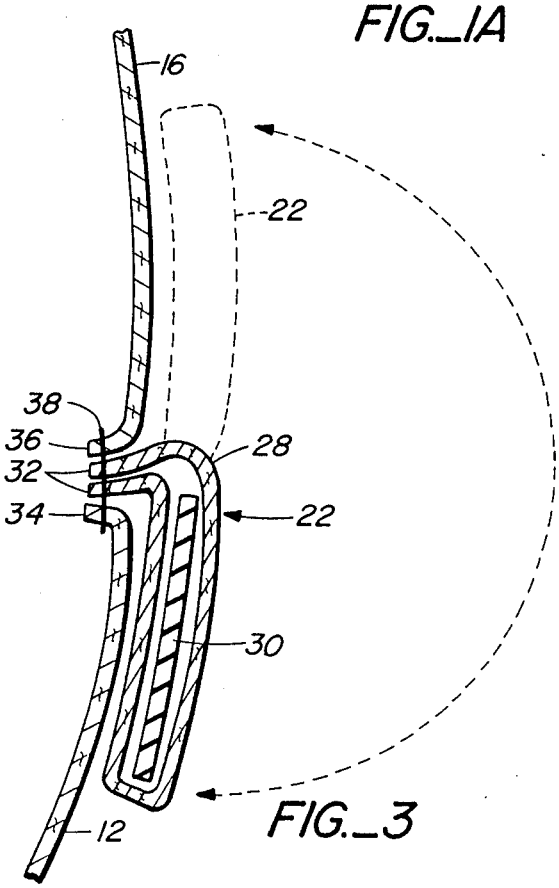
FIG. 3 is an enlarged fragmentary view in section showing the waist band for the garment of FIGS. 1 and 2 according to the invention.

The attachment of the band 22 to the garment 10 is shown in detail in the enlarged sectional view of FIG. 3.

In the embodiment illustrated the band 22 is comprised of an outer member 28 of elastomeric material such as a fabric having embedded elastomeric strands or strips. This outer member extends around and is attached to an enclosed strip 30 of elastomeric material such as a rubberized belting material. The end edges 32 of the outer member are brought together and extend between flange portions 34 and 36 of the lower and upper garment sections 12 and 16. The end edges 32 and the flange portions 34 and 36 are covered and stitched together by thread material 38 that serves as a retaining means. Thus, as seen in FIG. 3, the band 22 is fixed to the upper and lower garment sections so that it can pivot from a lower position to an upper position. The outer member 38 near its connection with the garment sections 12 and 16 serves as a hinge-like means to facilitate the upper to lower waist band movement.

From the foregoing, it is seen that the present invention provides a garment for pregnant women that enables a wearer to quickly and easily adjust a supporting waist band to suit different conditions of activity and changing physical characteristics. Although the garment has been shown with a short lower pants section and a sleeveless upper section, it should be apparent that various other garment configurations could be used within the scope of the invention.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. A garment adapted to be worn by a person to provide abdominal support during bodily activity, said garment comprising:

an upper body section with front and back portions connected by shoulder straps forming arm holes:

a lower body section connected to the upper body section having front and back portions;

a continuous elastomeric band means extending completely around said lower body section, said back portion of said lower body section having an upper edge that is higher than an upper edge of said front portion so that said upper edge of said back portion is adapted to fit generally across a wearer's lumbar spine region, while said upper edge of said front portion is adapted to fit across the wearer's lower abdominal region, and having continuous opposite edges, and hinge means attached along an edge of said band means and to said upper edge of said lower body section to thereby enable said band means to be moved from a relatively low position on the garment to a relatively high position in order to provide a range of abdominal support to accommodate different wearer sizes and wearer activities.

2. The garment as described in claim 1 wherein said band means comprises an outer cover of fabric material and an inner layer of elastomeric belt material, one edge of said band means being stitched to said garment.

3. The garment as described in claim 1 wherein said one edge of said band means is stitched to edge portions of both said upper and lower body sections, thereby forming said hinge means for said band means.

* * * * *